US008262247B2

(12) United States Patent
Yu

(10) Patent No.: US 8,262,247 B2
(45) Date of Patent: Sep. 11, 2012

(54) METHOD AND APPARATUS FOR DIRECTING A FLASHLIGHT

(76) Inventor: David Chen Yu, Laguna Niguel, CA (US)

( * ) Notice: Subject to any disclaimer, the term of this patent is extended or adjusted under 35 U.S.C. 154(b) by 253 days.

(21) Appl. No.: 12/773,242

(22) Filed: May 4, 2010

(65) Prior Publication Data

US 2011/0273870 A1 Nov. 10, 2011

(51) Int. Cl.
*F21L 4/00* (2006.01)

(52) U.S. Cl. ..... 362/191; 362/103; 362/396; 362/427

(58) Field of Classification Search ..... 362/103–108, 362/190–191, 200–208, 396, 427
See application file for complete search history.

(56) References Cited

U.S. PATENT DOCUMENTS

| | | | | |
|---|---|---|---|---|
| 1,403,707 | A * | 1/1922 | Quarnstrom | 362/396 |
| 2,778,931 | A | 1/1957 | Cruz et al. | |
| 4,040,547 | A | 8/1977 | Dickey | |
| 4,697,226 | A * | 9/1987 | Verdin | 362/110 |
| 4,984,724 | A | 1/1991 | Johnston | |
| 5,893,630 | A | 4/1999 | Mosquera | |
| 2007/0159809 | A1 | 7/2007 | Kim et al. | |

* cited by examiner

*Primary Examiner* — Jason Moon Han

(57) ABSTRACT

A method and apparatus for directing a flashlight is provided. The apparatus comprises: a base; a receptacle mechanically coupled to the base; a clip mechanically coupled to the opposite side of the base capable of securing the apparatus to an article of clothing; and one or more hinges mechanically coupled to the base and receptacle, and optionally one or more straps mechanically coupled to the receptacle for attaching a flashlight to the receptacle. Such apparatus and related methods facilitate directing a flashlight's beam in front of a user while simultaneously securing the flashlight to a user's article of clothing.

19 Claims, 3 Drawing Sheets

METHOD AND APPARATUS FOR DIRECTING A FLASHLIGHT

BACKGROUND OF THE INVENTION

The present invention pertains to a method and apparatus for directing a flashlight.

Flashlights are widely used in applications ranging from repair work in dark spaces, to camping, and in emergencies causing loss of power. A conventional flashlight is typically a cylindrically shaped tube with a lamp and reflector on one end capable of aiming light in a certain direction. A conventional flashlight is gripped by a user along the circumference of the cylinder and aimed by pointing the flashlight's reflector.

Conventional flashlights generally require a user to grasp a handle with one or more hands while directing the beam of light. Some flashlights are small and easy to hold, requiring only one hand to control them, while others are heavier and project a larger and brighter beam of light. These heavier flashlights may require a user to use both hands to guide the beam. In many cases the user deals with the difficulty by propping the flashlight along adjacent objects while simultaneously trying to aim the flashlight in the desired location and position. This is hardly an ideal situation as the typical cylindrical shape of many flashlights makes propping the flashlight difficult and unreliable.

There is a need in the art for a method and apparatus for supporting and directing a flashlight without requiring separate supports. Particularly desirable is an apparatus and method of attaching a flashlight to a user's clothing, allowing the flashlight to be carried by the user during periods of use and non-use.

SUMMARY OF THE INVENTION

The present invention provides for an efficient and convenient apparatus for directing a flashlight, particularly an apparatus that allows a user to direct a flashlight without requiring both hands. In an embodiment, the apparatus is capable of being efficiently and securely attached to the user's clothing and also allows deployment of the flashlight for use, and for storage when the flashlight is not in use.

According to an embodiment, an apparatus for directing a flashlight comprises: a base; a receptacle mechanically coupled to the base; a clip mechanically coupled to the opposite side of the base capable of securing the apparatus to an article of clothing; one or more hinges mechanically coupled to the base and receptacle, and optionally one or more straps mechanically coupled to the receptacle for attaching a flashlight to the receptacle. Such apparatus and related methods facilitate directing a flashlight's beam in front of a user while simultaneously securing the flashlight to a user's article of clothing.

Various aspects and embodiments of the invention are described in further detail below.

BRIEF DESCRIPTION OF THE SEVERAL VIEWS OF THE DRAWINGS

The present invention described herein will become apparent from the following detailed description considered in connection with the accompanying drawings, which disclose several embodiments of the invention. It should be understood, however, that the drawings are designed for the purpose of illustration and not as limits of the invention.

DETAILED DESCRIPTION OF THE INVENTION

Figure 1A:
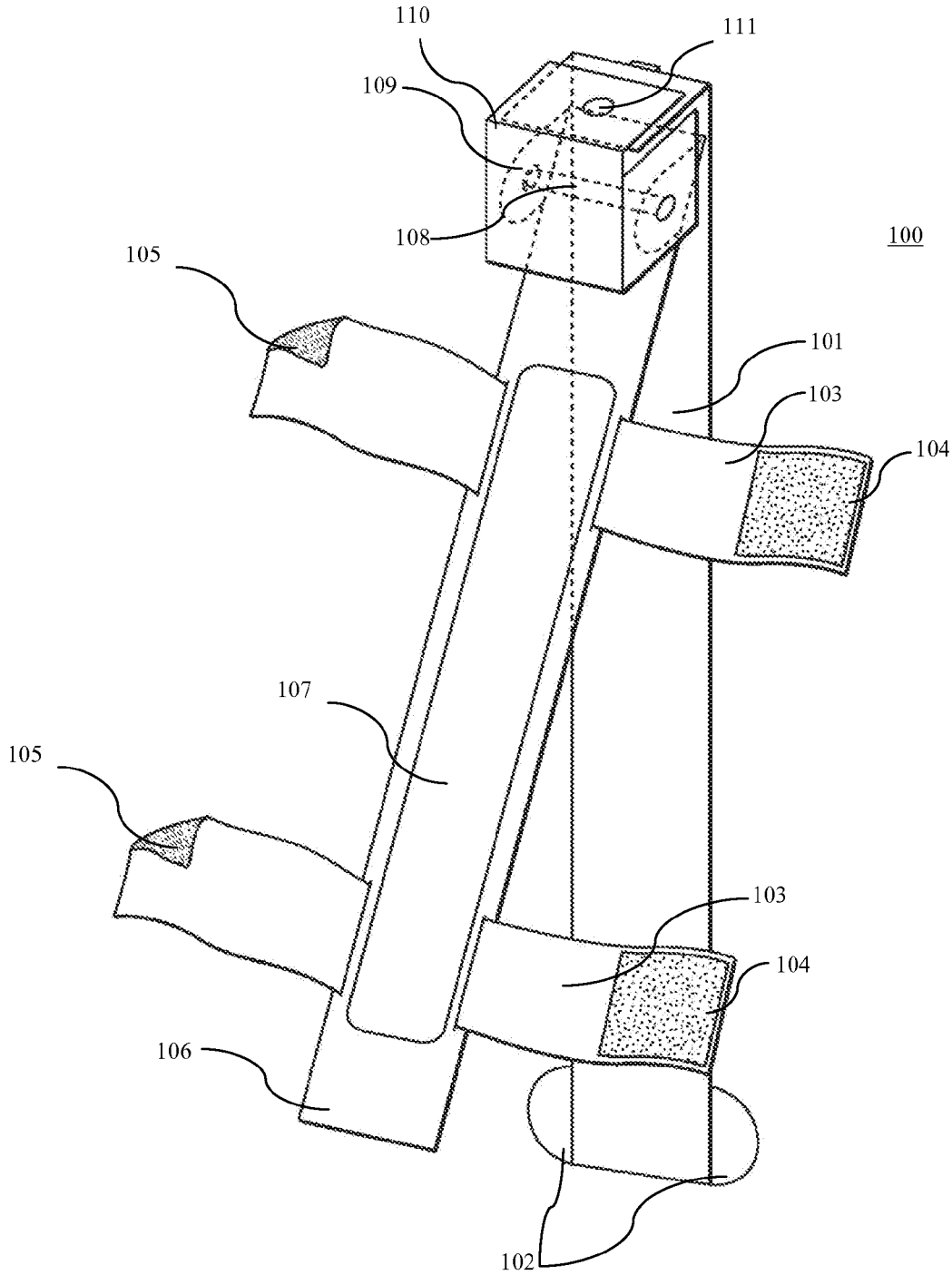
FIG. 1A is a perspective view of one embodiment of an apparatus for directing a flashlight according to the invention.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

The present invention provides for an efficient and convenient apparatus for directing a flashlight, particularly an apparatus that directs a flashlight beam in front of a user. The apparatus of the invention may efficiently and securely attached an article of the user's clothing and is capable of deploying the flashlight when in use, or storing the flashlight when not in use. An embodiment allows a user to attach a conventional flashlight to the user's clothing and then direct the flashlight beam as needed or desired. The device or apparatus easily attaches to an article of clothing such as a shirt pocket, and is capable of accepting a wide variety of flashlight shapes and sizes.

In an embodiment, the apparatus generally comprises: a base; a receptacle mechanically coupled to the base; a clip mechanically coupled to the opposite side of the base permitting securing the device to an article of clothing; one or more hinges mechanically coupled to the base and receptacle, and optionally one or more straps mechanically coupled to the receptacle for attaching a flashlight to the receptacle.

By securing a flashlight to an article of clothing, the apparatus facilitates directing, carrying, and storing of a flashlight in a hands-free manner, allowing the user to use both hands for a task. The apparatus further provides a convenient method of storing the flashlight by pivoting the flashlight away when not in use while secured to the user's clothing.

According to an embodiment, the straps adjust to accommodate a variety of flashlight shapes and sizes. For example, using apparatus of the invention, a conventional flashlight, i.e. a cylindrically shaped flashlight, is placed on the receptacle and the straps are wrapped around the body of the flashlight, securing it in the receptacle. The receptacle straps may be adjusted based on the shape and dimensions of the flashlight. Exemplary designs of the adjustable receptacle straps include wide bands with reclosable ends, which may utilize hook and loop fabric sections. In yet another exemplary embodiment, the flashlight may be secured to the receptacle by a plurality of straps and a buckle.

Advantageously, the apparatus facilitates securing the flashlight to the user while simultaneously directing the flashlight's beam. Both of the user's hands are free to complete a task while the flashlight is in use. The apparatus may be easily secured to the user's clothing, allowing the flashlight to be stowed and carried when not in use.

Figure 1B:
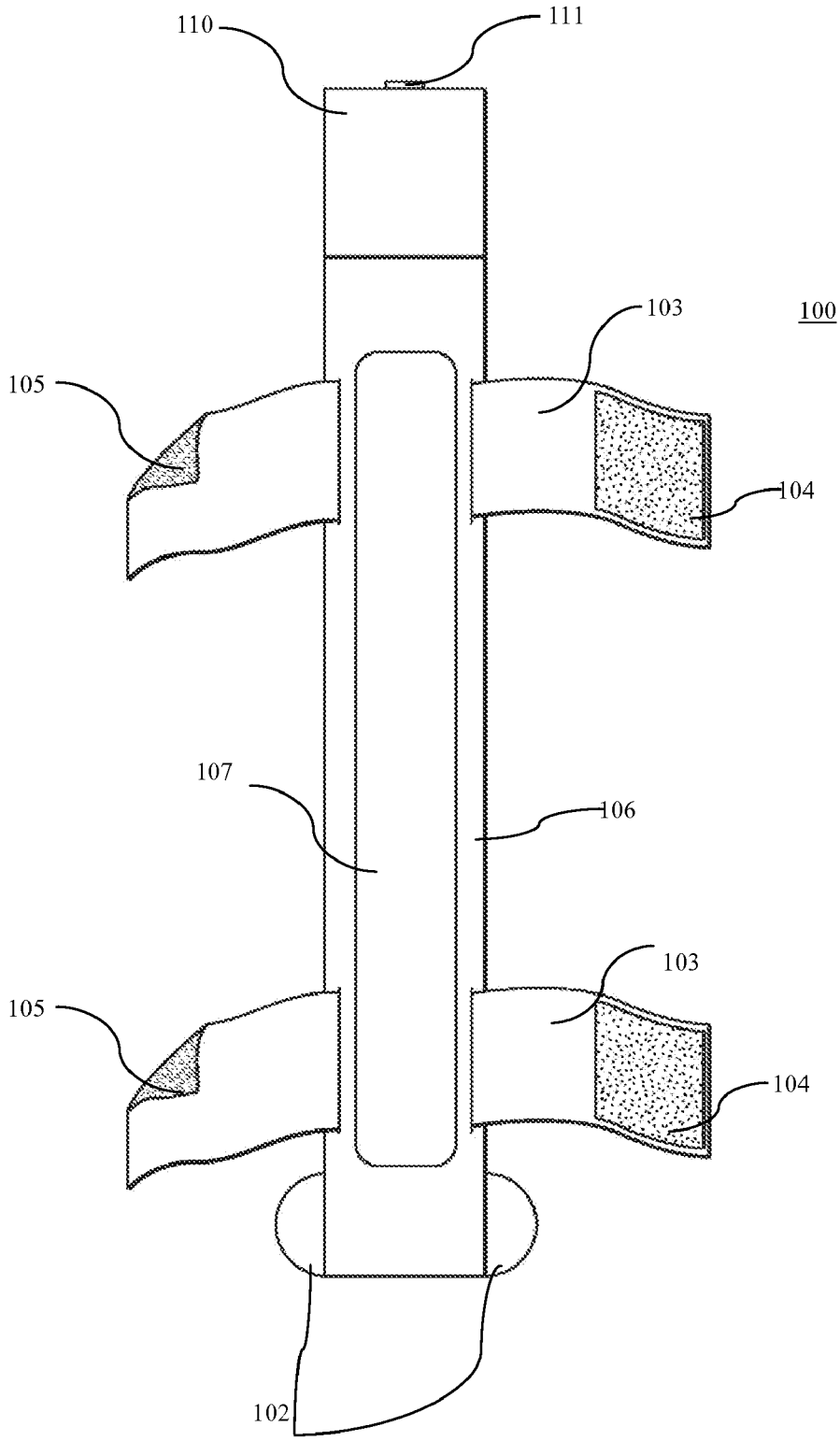
FIG. 1B is a front view of the apparatus of FIG. 1A.

As illustrated in FIGS. 1A and 1B, an exemplary apparatus 100 of the invention may be attached to a user's clothing. The apparatus is comprised of the following: a base 101, optionally a plurality of supports 102, a plurality of straps 103, a plurality of fabric hooks 104 and fabric loops 105, a receptacle 106, axle 108, hinges 109 and 111, a cover 110, and a clip 201.

The base 101 is constructed to allow a user to secure the apparatus 100 to an article of clothing, e.g. inside a shirt pocket, collar or sleeve. The base 101 comprises a flat bar and may be formed from any suitably durable material. The base 101 may be any shape suitable for securing the apparatus 100 to an article of clothing. The base 101 may further optionally comprise a plurality of supports 102, which may comprise semicircular tabs. According to an exemplary embodiment, the base 101 and the plurality of supports 102 are formed as two discrete components, which are then mechanically coupled when forming the apparatus 100. The one or multiple components of the base 101 and plurality of supports 102 may be formed using any suitable methodology. In an exemplary embodiment, the components are formed by molding.

Figure 1C:
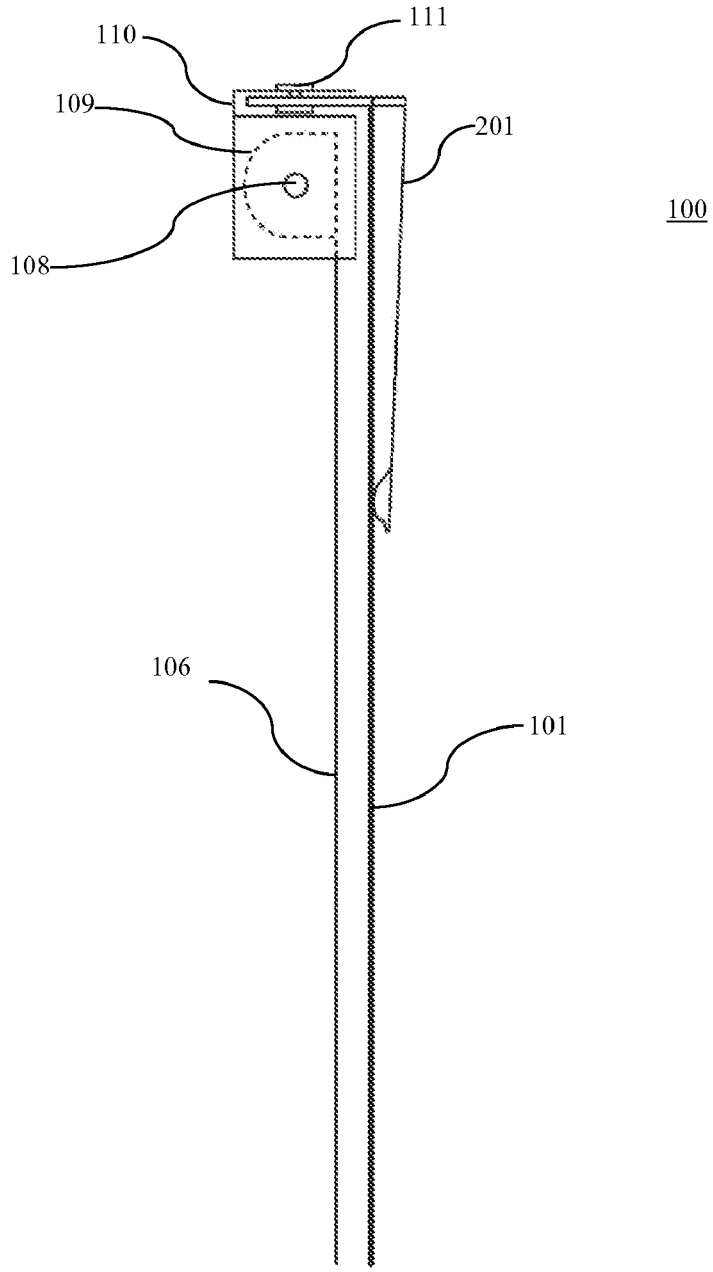
FIG. 1C is a side view of the apparatus of FIG. 1A.

As illustrated in FIGS. 1A and 1C, the base 101 is mechanically coupled to a first side of a hinge 111. The hinge 109 may be formed using any suitable methodology. According to an exemplary embodiment, the hinge 109 and axle 108 are formed as two discrete components, which are then mechanically coupled when forming the apparatus 100. Axle 108 connects hinges 109 on both sides of the cover 110. Hinge 109 connects and holds receptacle 106 within cover 110. In addition, hinge 109 also controls the vertical movement of receptacle 106. Hinge 109 is a friction hinge. A friction hinge has its movement restricted by a restrictive circular wire wrapped around the axle. A friction hinge allows receptacle 106 to be elevated and maintained in the selected elevated position.

As illustrated in FIGS. 1A and 1C a first end of the receptacle 106 is mechanically coupled to the hinges 109. The axle 108 and hinge 109 may be formed by any suitable methodology. The receptacle 106 comprises any suitable shape for providing a secure surface to attach a flashlight According to an exemplary apparatus 100, the receptacle 106, is a flat bar capable of attaching to a conventional flashlight. The receptacle 106 may further provide on a top side, a surface material 107 that facilitates the securing or retaining of a flashlight. The surface material 107 may comprise any material or texture that provides for a relatively high coefficient of friction between a conventional flashlight and the surface material 107. According to the exemplary embodiment, the receptacle 106 and surface material 107 are formed as two discrete components, which are then mechanically coupled when forming the apparatus 100. The one or multiple components of the receptacle 106 and surface material 107 may be formed using any suitable methodology.

Cover 110 connects receptacle 106 to base 101. Hinge 111 connects base 101 to cover 110. Hinge 111 allows horizontal movement of cover 110. This also allows receptacle 106 to move horizontally because cover 110 is connected to receptacle 106 through hinge 109.

As illustrated in FIGS. 1A and 1B, the receptacle 106 is further mechanically coupled to a plurality of straps 103. The plurality of straps 103, may comprise any suitably flexible material such as nylon that allows a conventional flashlight to be secured to the receptacle 106. The plurality of straps 103 and receptacle 106 may comprise any suitable shape and size to allow flashlights of various dimensions to be secured. In an exemplary embodiment the plurality of straps 103 may further comprise plurality of fabric hooks 105 and fabric loops 104 mechanically coupled to the ends of the plurality of straps 103. The fabric hooks 105 and loops 104 may be capable of securing the ends of the plurality of straps 103 around a conventional flashlight and provide resealable and reliable closure.

As illustrated in FIG. 1C, the base 101 comprises a clip 201. According to an embodiment, the base 101 and clip 201 are formed as two discrete components, which are then mechanically coupled when forming the apparatus 100. The one or multiple components of the base 101 and clip 201 may be formed using any suitable methodology. The clip 201 may be comprised of any relatively flexible material capable of securing the base 101 to an article of clothing. In exemplary embodiments the clip 201 may be comprised of stainless steel or a durable plastic.

When a user operates the apparatus 100, the receptacle 106 is capable of pivoting outward directing the flashlight in front of the user, e.g. perpendicular to the user's body. In an embodiment, the hinges 109 and 111 may comprise a ratchet disk or other assembly to allow the receptacle 106 to be secured in any pivoted position. When the flashlight is not in use it may be stowed by the user by pivoting receptacle 106 downward, i.e. parallel to the base 101.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for directing a flashlight, comprising:

a base having one or more support tabs, wherein the base and the support tabs are formed as two discrete components and mechanically coupled when forming the apparatus;

at least one hinge capable of pivoting a receptacle, mechanically coupled to the base;

the receptacle mechanically coupled to the at least one hinge, wherein the hinge further comprises a friction hinge with movement restricted by a circular wire wrapped around an axle, wherein the friction hinge allows the receptacle to be elevated and maintained in the selected elevated position, wherein the hinge comprises a ratchet to secure the receptacle in a predetermined direction for directing the flashlight;

a cover connecting the receptacle to the base through the hinge, wherein the hinge connects the base to cover and wherein the hinge allows a horizontal movement of the cover and allows the receptacle to move horizontally;

one or more straps mechanically coupled to the receptacle for securing the flashlight to the receptacle; and at least one clip for securing the apparatus to an article of clothing.

2. The apparatus of claim 1, further comprising one or more fabric hooks and loops mechanically coupled to the one or more straps.

3. The apparatus of claim 1, further comprising one or more supports mechanically coupled to the base.

4. The apparatus of claim 1, further comprising a surface material mechanically coupled to the receptacle.

5. The apparatus of claim 1, wherein the receptacle is a flat bar capable of supporting a conventional cylindrical flashlight.

6. The apparatus of claim 1, wherein the cover is mechanically coupled to the at least one hinge.

7. The apparatus of claim 1, wherein the clip is a flexible material capable of attaching the apparatus to an article of clothing.

8. The apparatus of claim 1, wherein the clip comprises stainless steel.

9. The apparatus of claim 1, wherein the clip comprises plastic.

10. The apparatus of claim 1, wherein the one or more straps comprise flexible material.

11. The apparatus of claim 1, wherein the plurality of straps comprises a buckle.

12. The apparatus of claim 1, wherein the plurality of straps comprise hook and loop fabric sections.

13. The apparatus of claim 1, wherein the receptacle comprises at least one slot for insertion of the one or more straps.

14. The apparatus of claim 1, wherein the receptacle is shaped to allow the insertion and securing of the flashlight.

15. The method of claim 14, wherein the flashlight is directed perpendicularly to the base.

16. The method of claim 14, wherein the flashlight is stored by pivoting the receptacle parallel to the base.

17. The method of claim 14, wherein the receptacle is pivoted to direct the flashlight at an angle from the base.

18. The apparatus of claim 1, wherein the apparatus facilitates the directing of the flashlight in front of a user without occupying the user's hands.

19. A method for applying directing flashlight, the method comprising:

providing the apparatus of claim 1;

attaching the apparatus to the article of clothing with the at least one clip securing the flashlight to the receptacle; and directing the flashlight by pivoting the receptacle along the one or more hinges.

* * * * *